US005603993A

United States Patent [19]

Ampomah

[11] Patent Number: 5,603,993

[45] Date of Patent: Feb. 18, 1997

[54] DISPOSABLE PAPER FORTUNE ORNAMENT

[76] Inventor: Tammy Ampomah, 147 W. Como Ave., Columbus, Ohio 43202

[21] Appl. No.: 516,503

[22] Filed: Aug. 17, 1995

[51] Int. Cl.[6] ..... B42D 15/02; G09F 3/14

[52] U.S. Cl. ..... 428/7; 428/19; 428/34.2; 428/64.1

[58] Field of Search ..... 428/7, 14, 19, 428/34.2, 64.1

[56] References Cited

U.S. PATENT DOCUMENTS

| | | | |
|---|---|---|---|
| 4,187,628 | 2/1980 | Thompson | 428/14 X |
| 4,215,497 | 8/1980 | Levy | 428/7 X |
| 4,387,530 | 6/1983 | Miller | 428/14 X |
| 4,510,189 | 4/1985 | Girard | 428/19 |

*Primary Examiner*—Henry F. Epstein
*Attorney, Agent, or Firm*—Jason H. Foster; Kremblas, Foster Millard & Pollick

[57] ABSTRACT

This invention relates to articles for decoration and amusement. Specifically the present invention relates to a Christmas tree ornament consisting of two equal halves in the form of prefabricated paper, cardboard or other sheet materials which are joined essentially composing a flat body. The body exhibits exterior shape in many geometric and whimsical forms. The ornament is provided with means for hanging such as cord or the like. The invention offers a multipurpose function, serving as seasonal decoration as well as a disposable storage unit for smaller articles such as a strip of paper containing words of wisdom, well wishes, a catch phrase or a fortune if you will. Other articles such as festive confetti and a penny for good luck are also contained inside ornament to serve as gifts and amusement for the new year. Ornament is placed on tree at Christmas as decoration and taken from tree on New Year's Eve or New Year's Day and given as gift. When ornament is torn open, contents may be read, and exchanged, and confetti may be thrown in celebration by a party or group.

6 Claims, 3 Drawing Sheets

DISPOSABLE PAPER FORTUNE ORNAMENT

BACKGROUND DISCUSSION OF PRIOR ART

Before the prescribed time in the Christmas tree ornament business, no ornament has had a multipurpose function with the capacity of complete disposability and biodegradability. Traditionally consumers have purchased ornaments manufactured from glass, wood, clay, cardboard, woven fabrics and plastics for their decorative usage and endurance. Although these ornaments uniform appearance is highly decorative and are considered keepsakes in a traditional sense, these ornaments also offer a depreciative quality over a period of time and are prone to breakage. An ornament of the type in present use can often be large in size and heavy in weight making it difficult to achieve the decorative effect the consumer strives to accomplish. Ornaments in use presently are not discarded after presentation but are placed in storage, thereby allowing the possibility of breakage or damage to ornaments to increase. The present invention eliminates the above described problems.

DETAILED DESCRIPTION OF THE INVENTION

Figure 1:
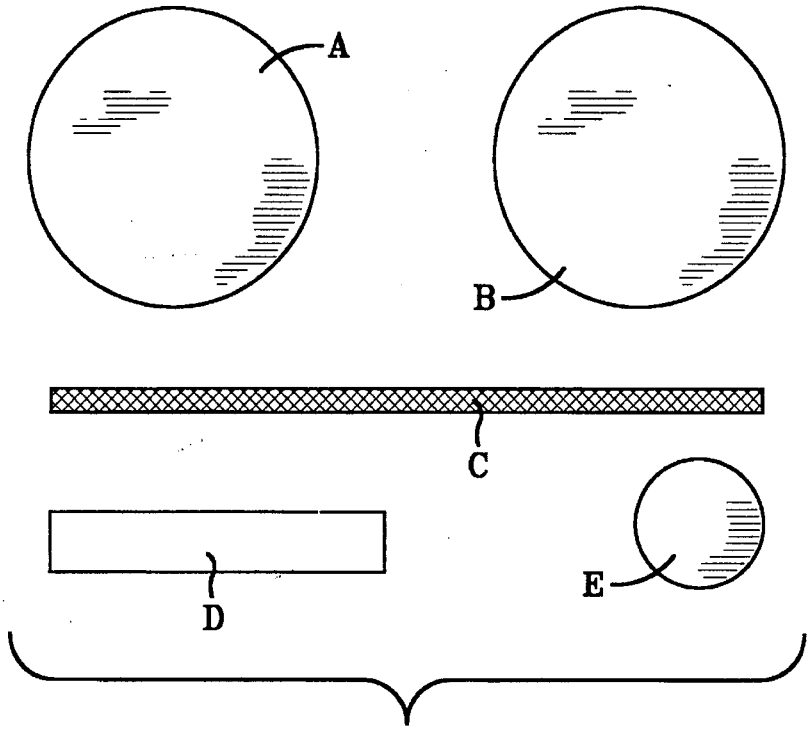
FIG. 1 is a schematic view showing items of invention.

With reference to the accompanying drawings the invention of the present patent specification as depicted in:

FIG. 1. shows individual items of invention. Items A and B represents two equal halves cut from prefabricated papers, cardboard and other sheet materials in various shapes and sizes. Item C represents heavy threading or cord; rectangular strip of paper depicting words of wisdom are good fortune represent item D. Item E represents a penny.

Figure 2:
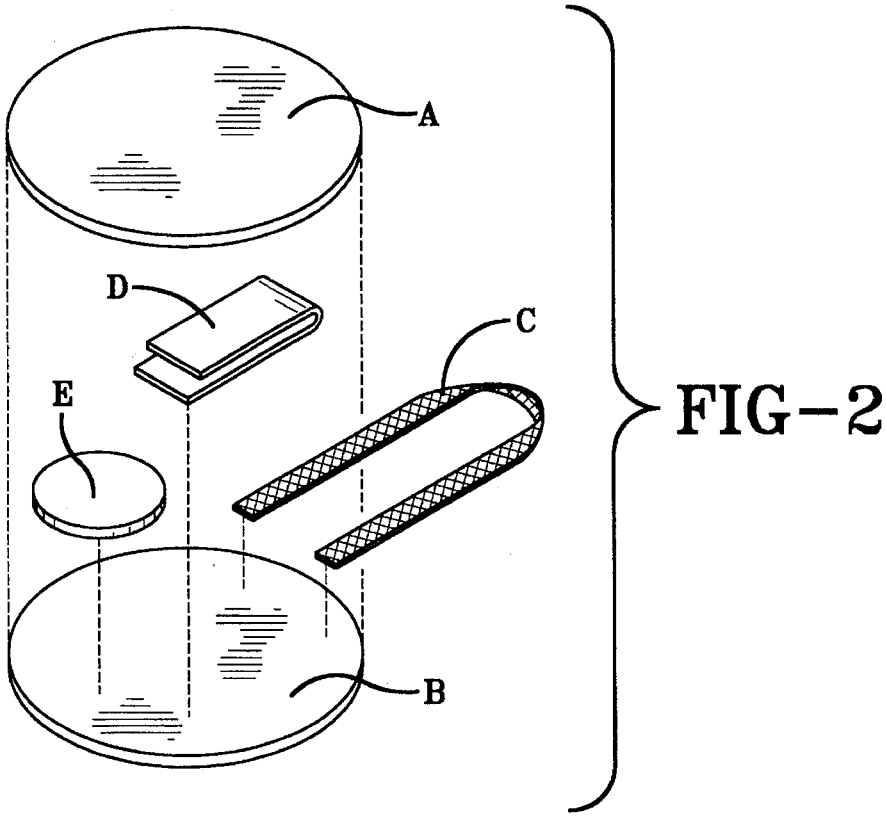
FIG. 2 is a schematic view showing steps of assemblage.

FIG. 2. is a perspective view showing steps of assemblage. 1. Adhesive will be placed around edge of item B leaving upper edge free of adhesive. 2. Item D will be folded; item E will be placed into fold of item D. Both items D and E are then placed in center of item B. 3. Place item A on top of item B with edges evenly together. Press along edges to seal. 4. Once the invention has been assembled by joining the two flat surfaced halves, the next step is to pour confetti into opening located at the upper edge of ornament. Adhesive is then placed along upper edge inside opening. 5. Item C will be folded or doubled upon itself so as to leave an opening between the parts, causing a loop. Item C should then be inserted, with ends of cord or string evenly together, into opening of ornament resting ends of cord or string on adhesive. Press along outer edges to seal.

Figure 3A:
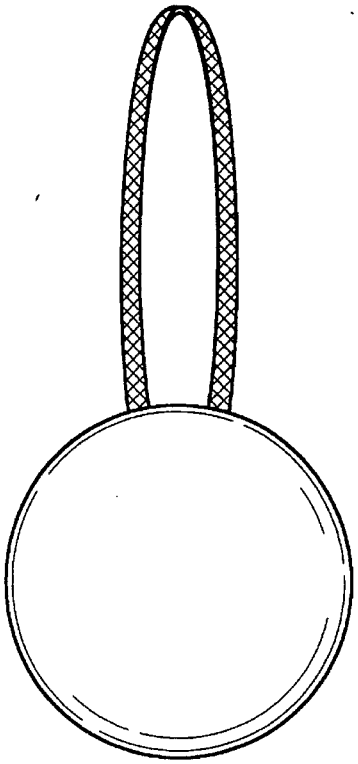
FIG. 3 is a front and side view of constructed ornament.
Figure 3B:
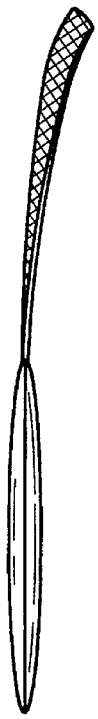

FIG. 3. is a perspective showing front and side views of constructed ornament.

Figure 4:
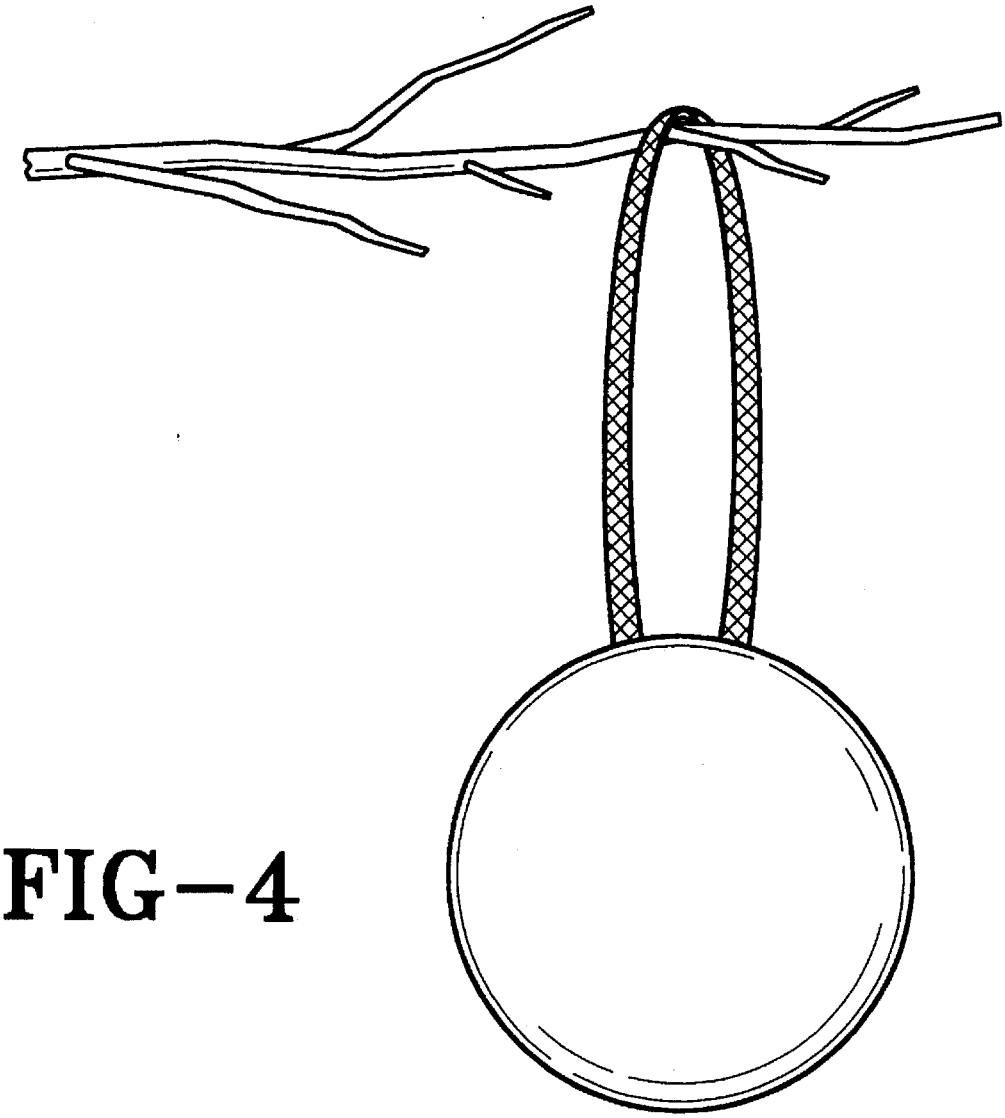
FIG. 4 is a perspective view of the invention in its operable position while hanging on a Christmas tree.

FIG. 4. is a perspective view of the invention in its operable position while hanging on a Christmas tree.

SUMMARY OF THE INVENTION

The object of this invention is to provide the consumer a multipurpose ornament capable of erring as decoration for a Christmas tree that also doubles as a disposable storage unit for smaller articles to be used as girls or amusement for the new year. An object of this invention is to provide the consumer with an ornament that is non breakable and will not depreciate because its complete disposability. Another object of this invention is to provide an ornament that is structured in two halves from prefabricated paper which is superior in its monetary durability, size, weight, and duo usage. An additional object is to provide the consumer with amusement and useful traditional keepsakes such as subjective enrichments for the new year.

Now in greater detail the ornament is composed of a flat body made two identical halves which will sandwich articles of amusement when edges are evenly placed together and fastened with an adhesive suitable for materials used. The outer surface of body will be adorned with prefabricated garnish making ornament more appearing. The provision for hanging ornament is adequately secured by inserting a single looped cord or string through opening at upper edges of ornament and sealing opening with an appropriate adhesive.

What I claim is:

1. A hangable ornament, comprising:

(a) a first substantially continuous planar panel having a peripheral surface;

(b) a second substantially continuous planar panel, disposed generally parallel to the first panel, and having a peripheral surface connected to the peripheral surface of the first panel, forming an enclosed internal chamber;

(c) at least one article of amusement housed in the internal chamber, concealed from view; and (d) a hanger, mounted to at least one of the panels, for hanging the ornament.

2. An ornament in accordance with claim 1, wherein dimensions of the first panel are identical to dimensions of the second panel.

3. An ornament in accordance with claim 1, wherein the panels are made of paperboard.

4. An ornament in accordance with claim 1, wherein the article of amusement is a coin.

5. An ornament in accordance with claim 1, wherein the article of amusement is a strip of paper.

6. An ornament in accordance with claim 1, wherein the hanger is a looped cord sandwiched between the connected panels.

* * * * *

UNITED STATES PATENT AND TRADEMARK OFFICE

CERTIFICATE OF CORRECTION

PATENT NO. : 5,603,993

DATED : Feb. 18, 1997

INVENTOR(S) : Ampomah

It is certified that error appears in the above-indentified patent and that said Letters Patent is hereby corrected as shown below:

Column 2, line 8, "erring" should be --serving--. Column 2, line 10, "girls" should be --gifts--. Column 2, line 21, before "two" insert --of--.

Signed and Sealed this

Third Day of June, 1997

*Attest:*

*Attesting Officer*

Bruce Lehman

BRUCE LEHMAN

*Commissioner of Patents and Trademarks*